US011846467B2

(12) United States Patent
Schmidt et al.

(10) Patent No.: US 11,846,467 B2
(45) Date of Patent: Dec. 19, 2023

(54) APPARATUS FOR THE RAPID COOLING OF PACKAGED BEVERAGES

(71) Applicant: PULSACLASS SAS, Montevideo (UY)

(72) Inventors: Santiago Schmidt, Buenos Aires (AR); Luciano Cismondi, Buenos Aires (AR); Pablo Esteban Di Lorenzo, Buenos Aires (AR); Nicolás Kölliker Frers, Buenos Aires (AR); Marcos Condomí Alcorta, Buenos Aires (AR)

(73) Assignee: PULSACLASS SAS, Montevideo (UY)

( * ) Notice: Subject to any disclaimer, the term of this patent is extended or adjusted under 35 U.S.C. 154(b) by 474 days.

(21) Appl. No.: 17/274,104

(22) PCT Filed: Sep. 11, 2019

(86) PCT No.: PCT/ES2019/070600
§ 371 (c)(1),
(2) Date: Mar. 5, 2021

(87) PCT Pub. No.: WO2020/053464
PCT Pub. Date: Mar. 19, 2020

(65) Prior Publication Data

US 2021/0341220 A1 Nov. 4, 2021

(30) Foreign Application Priority Data

Sep. 13, 2018 (AR) ..... 20180102616

(51) Int. Cl.
*F25D 31/00* (2006.01)
*F25D 11/00* (2006.01)
*F25D 17/02* (2006.01)

(52) U.S. Cl.
CPC ..... *F25D 31/007* (2013.01); *F25D 11/00* (2013.01); *F25D 17/02* (2013.01);
(Continued)

(58) Field of Classification Search
CPC ..... F25D 2400/28; F25D 2331/805; F25D 2331/803; F25D 31/007; F25D 11/00; A23L 3/361
See application file for complete search history.

(56) References Cited

U.S. PATENT DOCUMENTS 4,549,409 A 10/1985 Smith
5,505,054 A 4/1996 Loibl et al.
(Continued)

FOREIGN PATENT DOCUMENTS

AR 2018102616 9/2018
BR 102017019228 A2 4/2018
(Continued)

OTHER PUBLICATIONS

Foreign Communication from Related Application—International Search Report and Written Opinion of the Internationa Searching Authority, International Application No. PCT/ES2019/070600, dated Nov. 18, 2019, 21 pages.
(Continued)

*Primary Examiner* — Cassey D Bauer
(74) *Attorney, Agent, or Firm* — Conley Rose, P.C.; Rodney B. Carroll

(57) ABSTRACT

An apparatus for the rapid cooling of packaged beverages that includes a thermally insulated immersion tank capable of containing a liquid refrigerant and an evaporator coil placed within the tank, where the container will be submerged while held by gripping means connected to a vertical rotation axis mounted on a vertically movable cart, both driven by driving means under the control of a control unit that commands a series of sequential steps such as driving the rotation of said axial rotation axis within a predetermined speed range and period of time followed by slowing down of the rotation of said axial rotation axis at a predetermined speed with a simultaneous vertical reciprocating
(Continued)

movement of the container by means of the vertically movable cart for a predetermined period of time as many times as established by the control unit.

5 Claims, 3 Drawing Sheets

(52) U.S. Cl.
CPC .. *F25D 2331/803* (2013.01); *F25D 2331/805* (2013.01); *F25D 2400/28* (2013.01)

(56) References Cited

U.S. PATENT DOCUMENTS

| | | | | |
|---|---|---|---|---|
| 2009/0000312 | A1 | 1/2009 | Smith et al. | |
| 2013/0160987 | A1 | 6/2013 | Grigorian | |
| 2013/0180280 | A1 | 7/2013 | Grigorian | |
| 2015/0114011 | A1* | 4/2015 | Benavides | F25D 31/007 62/64 |
| 2015/2336311 | | 8/2015 | Shuntich | |

FOREIGN PATENT DOCUMENTS

| | | | |
|---|---|---|---|
| EP | 3309115 | A | 4/2018 |
| JP | 2004361056 | A | 12/2004 |
| WO | 2015112192 | A1 | 7/2015 |
| WO | 2019099135 | A1 | 5/2019 |
| WO | 2020053464 | A1 | 3/2020 |

OTHER PUBLICATIONS

Foreign Communication from Related Application—Supplementary European Search Report, European Application No. 19860856.4, dated Jun. 10, 2022, 5 pages.

* cited by examiner

APPARATUS FOR THE RAPID COOLING OF PACKAGED BEVERAGES

CROSS-REFERENCE TO RELATED APPLICATION

This application is a filing under 35 U.S.C. 371 of International Application No. PCT/ES2019/070600 filed Sep. 11, 2019, entitled "Device for the Rapid Chilling of Canned Drinks," which claims the benefit of Argentine Application 20180102616, filed Sep. 13, 2018, the contents of which are hereby incorporated by reference in their entirety.

FIELD OF THE INVENTION

The present invention is related to the refrigeration or cooling of packaged products, more particularly, the present invention is related to an apparatus for rapidly cooling packaged beverages and reaching the desired temperature for consumption of the packaged beverage "on site" and "on the spot". The type of beverages that may benefit from the present invention are sodas, juices, beers, carbonated/sparkling water, among other massive consumption beverages, while the types of beverage containers may be the most varied, such as bottles, cans and the like.

PRIOR ART

Massive consumption of packaged beverages in public places, such as malls, stores, public transportation stations and terminals, and so on, is currently a large, consolidated and constantly expanding market. It is widely known that in the whole world there is a growing concern for the rational use of energy; in this sense, governments, companies and the population in general are becoming more aware of the need to rationalize the use of energy, which leads consumers to demand and appreciate low energy consumption products.

However, nowadays, the demands of modern life exert enormous pressure on product and service suppliers, which are forced to meet their customers' needs with increasing customization and speed, which is often not consistent with a rational use of energy. In other words, a customized consumer product that may be almost instantly obtained (on site and on the spot), in the conditions specified by the consumer (a beverage at the desired temperature) is a great challenge in view of those available in the commerce nowadays.

Traditionally, packaged beverages, such as for example, bottled or canned beverages of the most varied types, such as sodas/soft drinks, water, carbonated water, seltzer water, cider, beer, juices and the like, have been offered to the consumer public either from vending machines, self-service refrigerators or at the counter of stores, bars, etc., which keep them in traditional refrigerators, ice tubs, undercounter beverage coolers, etc.

In the particular case of vendor machines (such as those frequently found in train, bus or subway stations, and other public areas with high passenger and pedestrian circulation), it is the user himself/herself who, after introducing the required amount in the corresponding slot, selects and withdraws the packaged beverage, which is delivered through a take-out port.

In the particular case of traditional refrigerators. i.e., for example, of the type that can be found in gas stations, supermarkets, grocery stores, etc., beverage bottles or cans are stored in a refrigerator on a plurality of adjustable racks.

The inner part of the refrigerator is permanently refrigerated or cooled in cycles (on/off) that keep an adequate refrigeration temperature. They are frequently also used as product displays through their glass doors and inner lights. In this case, the customer or shop assistant takes the product directly from the racks or trays after opening one of the doors. It is known that at this time a substantial loss of frigories takes place and also there is no guarantee of the specific temperature of the chosen beverage.

Whatever the case, this type of refrigerators or coolers provide in general a thermally isolated and refrigerated chamber containing a number of bottles or cans at a temperature that the merchant considers appropriate for consumption according to the average customer's choice.

However, said traditional refrigerator appliances cool indistinctly all the beverages because cooling is achieved by removing heat from their inner space where the bottles, cans and the like are stored. These traditional refrigerator appliances have a very slow cooling cycle (by reason of their high thermal inertia) and are forced to constantly compensate losses of temperature every time a door is opened. Similarly, traditional refrigerators of any of the types described above consume electric power even during the idle periods along the day or inactive periods during the night, to compensate for temperature losses. Said temperature losses occur even when no bottles or cans are delivered to the consumer, as are heat losses caused by thermal conduction across the components of the apparatus as well as by imperfections and wear of the insulating elements (for example, gaskets).

However, although the installation and use of this type of refrigerators and beverage vending devices is still very common, several manufacturers and inventors have noticed the above mentioned power waste and therefore have proposed a variety of apparatuses and methods to avoid having to keep cold a complete inventory of beverage bottles or cans, irrespective of the fact that they are going to be consumed right away or not.

Said manufacturers and inventors have focused their efforts in achieving the fast cooling of an individual bottle or can, or a small group of beverage containers, only after the individual container or small group of containers has been selected by the consumer for immediate consumption. This is intended to avoid the unnecessary waste of power to cool the rest of the containers which have not been selected by the consumer, which otherwise would remain unnecessarily kept cold during long periods of time.

Some proposals for the fast cooling of packaged beverages are found in applications and patents of the prior art. For example, U.S. Pat. No. 5,505,054, Loibl et. al. Proposes to cool one or more beverage containers, from an initial temperature of about 30° C. to a final temperature of consumption of 5 to 7° C. This proposal consists in rotating the containers (preferably cans) around their respective axes, in a horizontal position, while they are sprayed with jets of water at 0° C. from multiple nozzles located above. Said temperature is defined as the equilibrium temperature with ice, and to that purpose a lower reservoir with water and ice is provided. Said patent states that it would not be convenient to make the can rotate with its longitudinal axis in vertical position, since it would cause the beverage inside to rotate as a rigid body (creating a vortex), which would result in long cooling times. The patent proposes to make the can rotate around its longitudinal axis in horizontal position, so that the air above the liquid will be continuously displaced, therefore creating a high degree of agitation and liquid displacement, which will result in an increase of the heat exchange surface area. Typically the expected cooling time for a 12 oz. (355 ml) can is about one and a half minute. The proposed rotating speeds of cans are in the range of 200 to 500 RPM. This is a clear indication that the sole purpose of this type of apparatuses is to agitate as much as possible the liquid in the container in order to maximize the heat exchange off the container.

Based on apparatuses of such type. i.e., apparatuses intended to achieve "on demand" cooling of packaged beverages, a new challenge in the art of cooling of packaged beverages arises. The challenge consists in obtaining a beverage that is cold enough to be accepted by the consumer, starting from a packaged beverage that has not been previously cooled (i.e. that is at an ambient temperature of about 25° C.) in the shortest possible time and with the least possible power consumption. It is understood that ambient temperature will vary depending on the location where the packaged beverage has been initially stored.

Such as mentioned above, current lifestyles have caused consumers to demand shorter waiting times to get a beverage cooled down to a desired consumption temperature. Accordingly, many of the prior art developments are intended to shorten cooling times by moving or agitating the beverage container in order to accelerate heat exchange, thus speeding up the cooling of the beverage inside the container, regardless its interaction with the external cooling medium, the risk of freezing certain portions of the beverage being cooled and/or the risk of inadequate agitation of a gasified beverage (i.e. containing dissolved $CO_2$), which could result in a violent degasification of the beverage upon the opening of the container.

The most recent proposals of the prior art, which are also the most relevant to the purposes of the present invention, are, by way of example only, US patent applications 2013/0160987 and its later improvement in US patent application 2013/0180280, both to Vartan Grigorian. In the former application US2013/0160987 Grigorian proposes an apparatus for the fast cooling of packaged beverages comprising a cavity for receiving the container to be cooled, which cavity is filled with a cooling liquid such as salt water, which can reach minus 16° C. a means to cause the container to rotate at 90 RPM, with the capacity to reach 720 RPM, during a preset period of time, then stopping or pausing rotation so that the liquid vortex collapses naturally, all of which suggests long waiting times, since the can should wait from 10 to 60 seconds after each rotation cycle. Said first proposal by Grigorian, besides said rotating means adapted to make the product (container) to rotate around an axis of the product, also proposes restraining means to avoid or substantially prevent the axial motion of the product while it rotates. This kind of proposal, although it could represent an effective means to achieve the cooling of a container by rotation around its axis in vertical position, cannot shorten cooling times to a meaningful degree, since the collapse of the stationary liquid vortex created by the rotation occurs naturally. An apparatus according to the teachings of document US2013/0180280 takes about 90 seconds (i.e. one and a half minute) to cool a typical 335 ml aluminum can from 25° C. down to 5° C. As it will become apparent in the detailed description of the present invention, such times will be greatly reduced by the apparatus of the present invention.

In the second document, US2013/0180280 Grigorian probably seems to acknowledge the shortcoming involved in the time wasted because of the stopping or pausing rotation, in order to have the stationary liquid vortex to collapse, therefore now proposes to avoid said pauses and instead having the container rotate in a continuous fashion along two different but parallel axes, one of which is the rotation axis of the product itself. This arrangement somewhat reduces the cooling times of the original application, probably because of the chaotic turbulence created within the container. In addition, it creates excessive turbulence in the external cooling medium, it does not bring into consideration the container geometry or the temperatures or the reduced cooling times compared to those in the original application, but is focused exclusively in the epicyclic rotation intended to avoid the inconvenient pauses in the original application. It does not disclose other ways of collapsing the stationary vortex, nor any particular and distinguishable explanation of a complete and functional industrial apparatus combining a specific structure with an operating mode such as the technical effect as the one proposed by the present invention. Some examples of variations of the disclosures of the second application are shown in the oscillating table of FIG. 1 (which does not employ the epicyclic rotation motion), which had to be cancelled later, since it does not share the characteristics claimed in said document. Therefore all the disclosures in said improved second document US2013/0180280 by Grigorian, and the cooling apparatus proposed thereby, are intended merely to agitate as much as possible the contents of the container placed within an excessively turbulent external cooling medium, just for the purpose of avoiding the inconveniently long waiting time of the original disclosure.

It is therefore understood that, given the current status of the prior art referred to the provision of apparatuses and/or methods for the fast on-demand cooling of packaged beverages, there is still the need to provide a novel and efficient apparatus capable of further minimizing the cooling times of packaged beverages, which apparatuses should have a sturdy and safe construction to be operated with liquids such as for example alcohols, allowing to achieve even lower immersion temperatures for the container, without the risk of beverage freezing, or the dissociation of carbon dioxide in the case of carbonated beverages.

SUMMARY OF THE INVENTION

The present invention is directed to the provision of an apparatus for the rapid cooling of packaged beverages intended for cooling, for example, soft drink cans, bottled beer, packaged juice or any other type of mass consumption beverages until a sufficiently cold beverage is obtained (preferably from 0° C. to 5° C., or at other temperatures, without limitation, depending on the consumer's preferences) in the shortest possible time, allowing the consumer to choose a packaged beverage just before consuming it with no need of prior refrigeration, i.e. while it is at room temperature (approx. 25° C. or more, or at the prevailing local temperature), and, once introduced into the apparatus of the present invention, and after a minimum waiting time (for example, a waiting time not exceeding 20 sec. for a soft drink can of approx. 335 ml), to obtain a refrigerated beverage at an optimum temperature for the consumer, i.e. at the temperature that the consumer considers sufficiently cold according to his/her preference.

BRIEF DESCRIPTION OF THE DRAWING

The present invention has been illustrated for better understanding by means of the following drawings which depict partial sectional views, enlarged views and certain schematic views of particular embodiments that someone skilled in the art will readily understand. They may also be used as teachings and constitute the bases for devising alternative embodiments by simply altering or modifying certain component parts with equivalent functionality, without departing from the scope of the present invention. These figures illustrate at least a preferred embodiment of the invention as follows.

DETAILED DESCRIPTION OF THE INVENTION

For a better description of the present invention, the same has been exemplified through a preferred embodiment, without this implying any limitation whatsoever to put into practice the present invention through alternative embodiments. In this sense, the present invention is illustrated as put into practice through said preferred embodiment comprising an apparatus (1) intended for the rapid cooling of packaged beverages (2) such as generally shown in FIG. 1.

Figure 1:
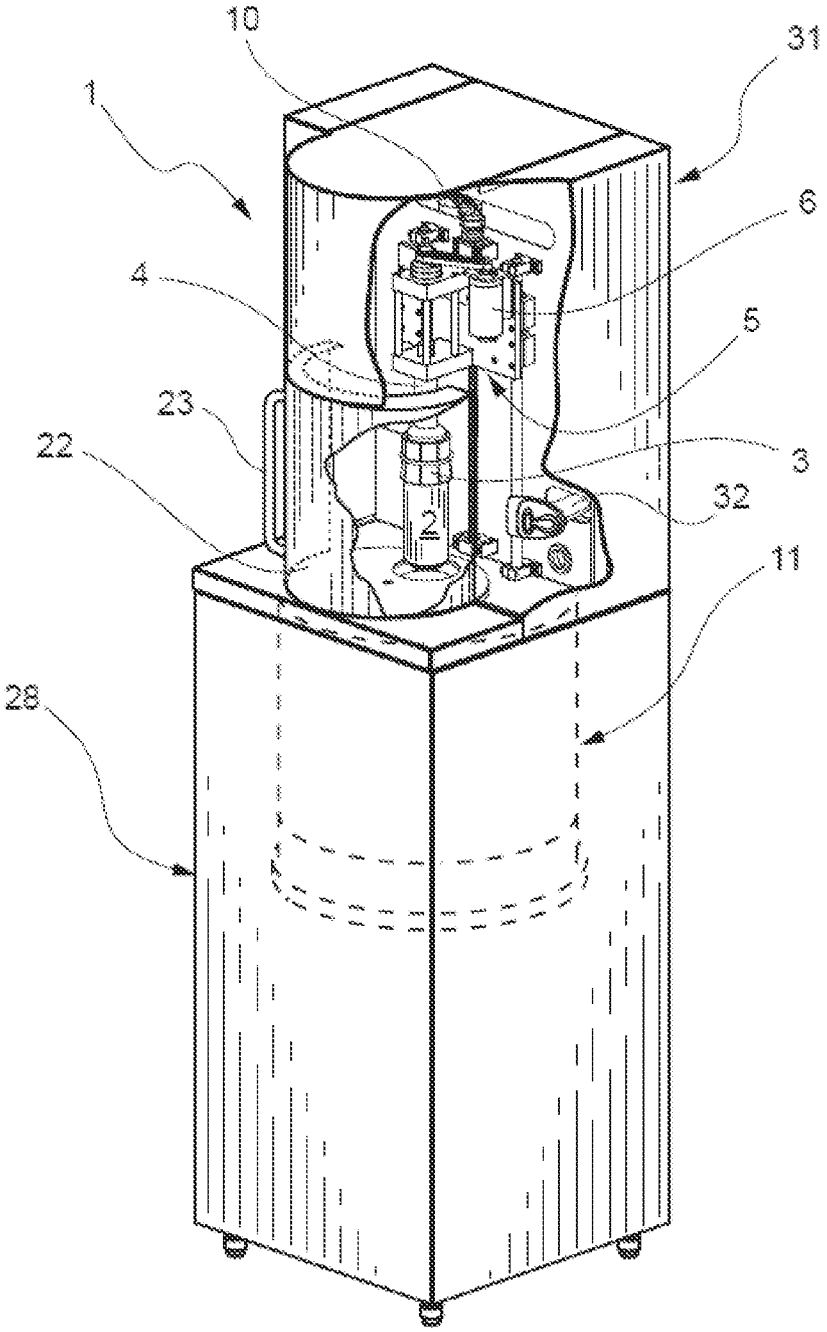
FIG. 1, is a perspective view of a first preferred embodiment of the apparatus of the present invention, showing its general construction and the general arrangement of some of its main internal components in a partial section, and identifying other internal components with a dashed line when they are behind the casing of the apparatus.

Considering that the apparatus (1) of the present invention is capable of being used in public places either by one or more users, the inventors have considered it appropriate to use a general arrangement such as the arrangement shown in FIG. 1, wherein the inner compounds and mechanisms are protected and safeguarded by means of a suitable cover. However, the aesthetic aspects of the apparatus may be designed as considered convenient, desired or needed, admitting, for example, shapes or images resembling a product for publicity or market-distinguishability purposes, or seeking to improve safety conditions or abide by safety rules, among others.

Particularly, for the purposes of the present invention, the inventors have adopted an outer cover design such as that shown in FIG. 1 applicable for a floor-standing embodiment. Such floor-standing embodiment is convenient by reason of its rapid installation and start up, in addition to an easy access by the user to the feeding and discharge (collection) ports of the packaged beverage (2). However, as any person skilled in the art will easily understand, there would be no impediments for the development of other versions of the apparatus such as table-top or wall-embedded models, as well as other industrial models.

In a general description, the apparatus (1) for the rapid cooling of packaged beverages (2) such as illustrated in FIGS. 1 to 4, has a lower portion that protects and hides an immersion tank (11) inside a cabinet (28), said immersion tank (11) being thermally insulated (21), and said immersion tank (11) being appropriate for containing a liquid refrigerant (14) that remains as a liquid at temperatures at least as low as −30° C. and even being capable of properly containing liquids such as ethyl alcohol at very low temperatures, such as for example −40° C., or more preferably −50° C. or as low as may be necessary.

The liquid refrigerant (14) is contained within the immersion tank (11), and will be the liquid in which the packaged beverage (2) will be cooled by immersion by a particular method as described in detail hereinbelow. For this reason, and considering that one of the purposes of the present invention is to reduce the cooling times of the beverage contained in the bottle or can (2), the temperature of the liquid refrigerant (14) will be as low as deemed convenient.

Said liquid refrigerant (14) contained within the immersion tank (11) is cooled by means of a closed cooling circuit, of the traditional type, but capable of reaching temperatures of down to approximately minus 30 degrees Celsius or even colder temperatures, such as for example minus 50 degrees Celsius. The closed cooling circuit includes a compressor (25) for fluid refrigerant, so that the fluid refrigerant is compressed and directed to a condenser (26) where the heat resulting from compression is released. Then, the fluid refrigerant is directed towards an evaporator coil (15) of said fluid refrigerant so as to absorb the heat from the liquid refrigerant (14) in which the packaged beverage will be immersed.

A liquid refrigerant (14) suitable to be used in the present invention is ethyl alcohol (ethanol). However, and as a person having ordinary skill in the art will readily understand, the liquid refrigerant, may be any other type of alcohol, or brines such as NaCl (−20° C.), $Cl_2Ca$ (−46° C.), an aqueous solution of glycol, appropriate combinations thereof, or other refrigerant liquids as long as they remain liquid at the sub-zero temperatures to be applied during the cooling cycles. Such as any person having ordinary skill in the art will readily understand, the container (2) will be submerged into the liquid refrigerant (14) and then will be manipulated by the consumer. Therefore, the use of non-toxic refrigerant liquids or other refrigerant liquids as approved by the local regulations is recommended. To such purpose, the use of ethanol (ethyl alcohol) is an advantageous and convenient option.

In addition, the refrigerant fluids of the closed cooling circuit may be, by way of example without limitation, R404A. R410A, as well as other refrigerant fluids well known in the refrigeration field, as long as they allow for the absorption of heat from the immersion tank in order to obtain temperatures of the refrigerant liquid (14) of down to, for example −30° C., more preferably −40° C. or even lower temperatures such as for example about −50° C. if necessary, depending on the operating temperature chosen to carry out the cooling cycles.

Figure 3:
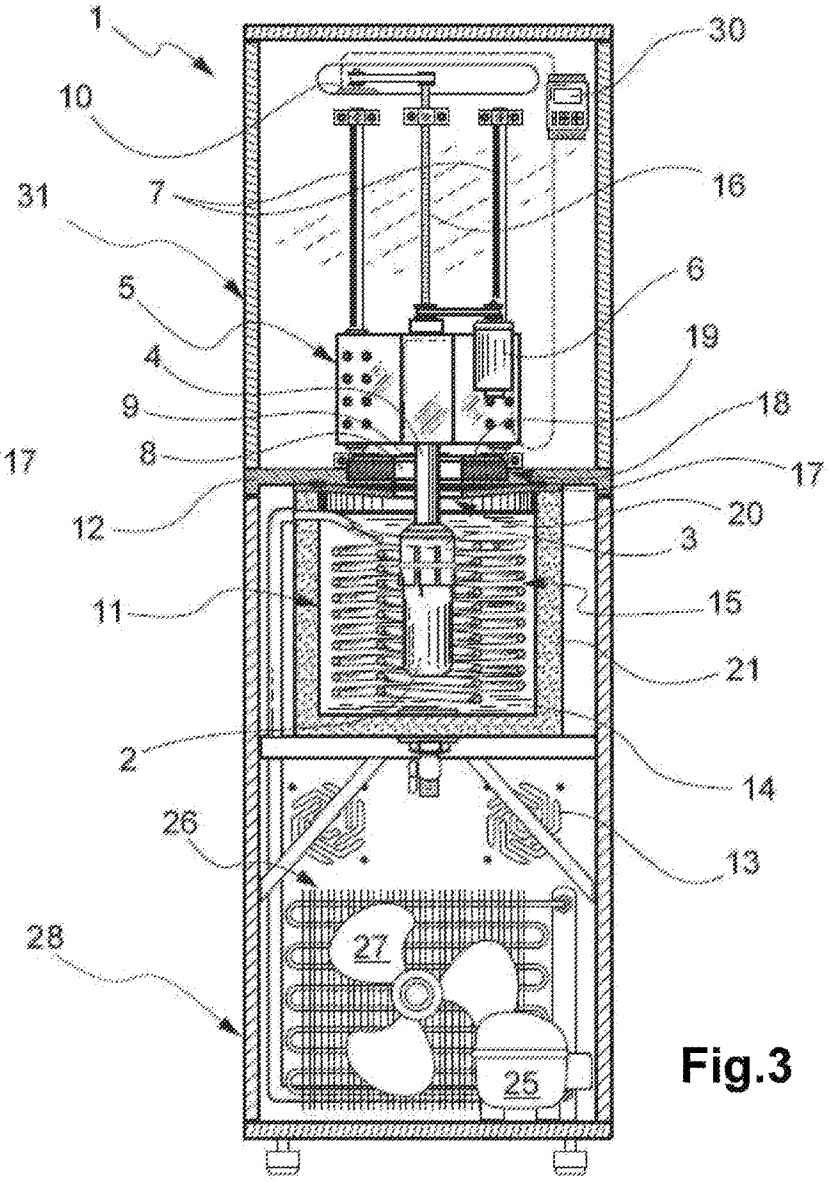
FIG. 3, is a front sectional view of the apparatus of the present invention according to the first preferred embodiment in the rapid cooling position of the beverage container, with the packaged beverage being submerged in the liquid refrigerant.
Figure 2:
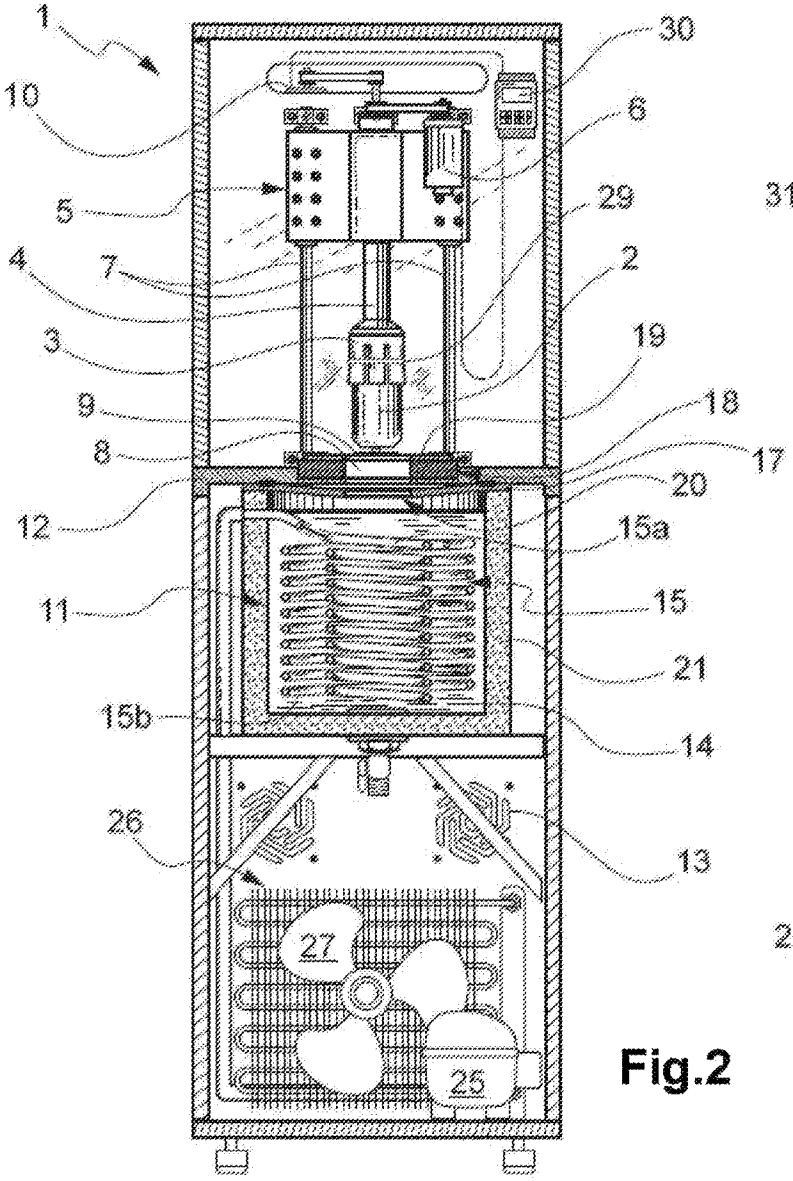
FIG. 2, is a sectional front view of the apparatus of the present invention according to the first preferred embodiment in the position of loading/unloading of the beverage container.
Figure 4:
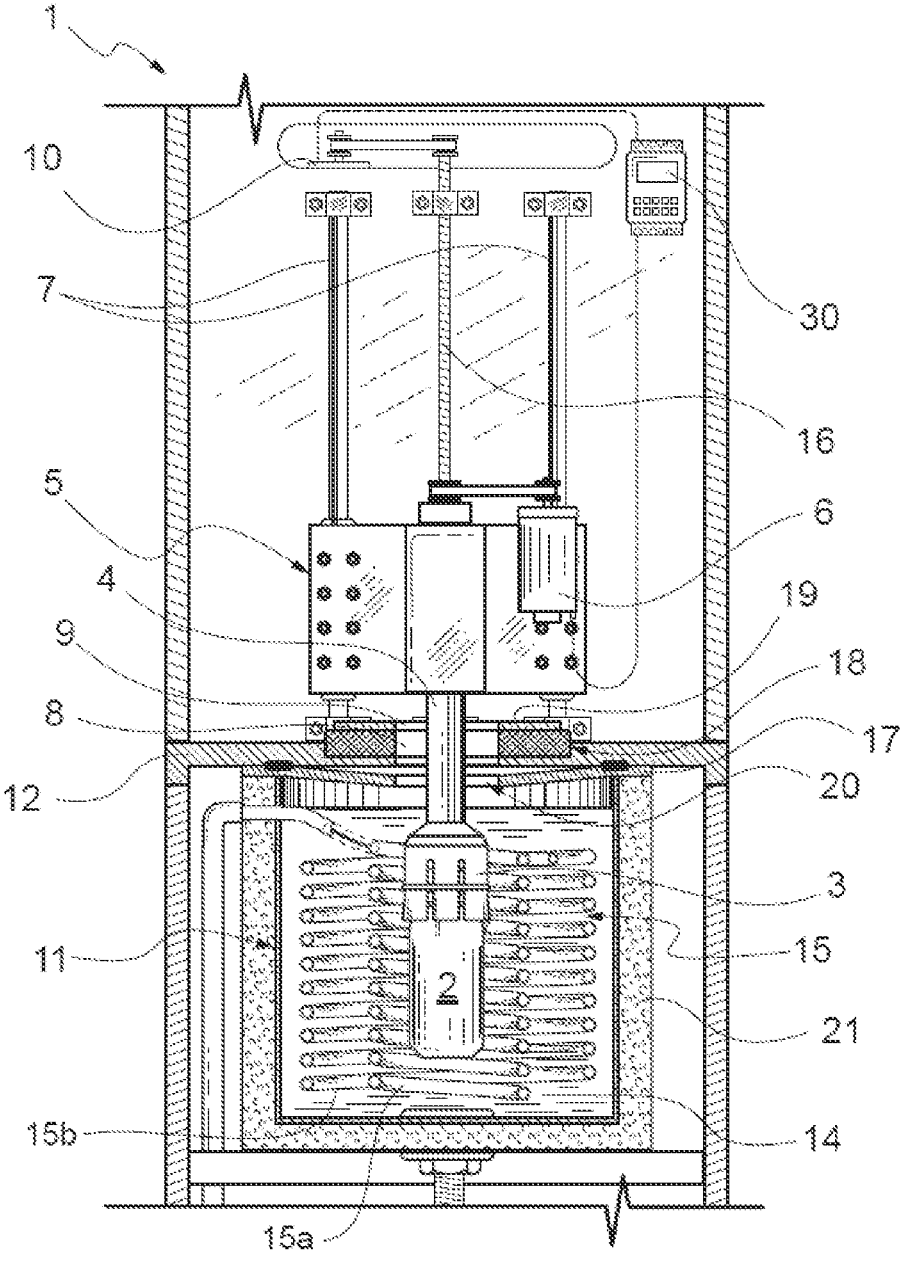
FIG. 4, is an enlarged partial view of an apparatus of the present invention such as illustrated in FIG. 3.

Such as illustrated in the accompanying FIGS. 2 to 4, the evaporator coil (15) for the fluid refrigerant of the closed cooling circuit is located within the immersion tank (11) and submerged into the liquid refrigerant (14). Particularly, such coil (15) comprises a first helical section (15*a*) shaped as a concentric coil located within a second external helical section (15*b*), thus achieving a surprising heat release effect from the central region of the immersion tank (11), i.e., the region of liquid refrigerant where the beverage container (2) will be submerged during its refrigeration process. Particularly, the closer the first helical section (15*a*) adjusts and approaches to the external surface of the container to be cooled, the better the evacuation of heat from the container.

It is convenient that the immersion tank (11) also has a cylindrical shape similar to that of both sections of the coils (inner coil 15*a*, outer coil 15*b*), therefore in the exemplary embodiment said immersion tank is illustrated with a cylindrical shape. Particularly, the first inner helical section (15*a*) corresponds to the section in which the fluid refrigerant in the closed circuit starts evaporating, thus obtaining the maximum heat evacuation capacity from the immersion liquid (14). Then, the fluid refrigerant keeps expanding and absorbing heat along the second outer helical section (15*b*).

Such as illustrated in FIGS. 2 and 3, the casing of the lower portion is provided with ventilation slots or grilles (13), such as those illustrated and/or others of a convenient type, which may vary in shape and number in order to let the heat generated in the condenser (26) be released in case the latter is hidden inside the casing.

In addition, it is convenient to provide a paddle fan (27) or any other means of forcing air circulation so as to improve heat evacuation performance from the condenser (26). Obviously, in some embodiments the condenser (26) may be adjacent to the apparatus, hidden behind the outer back wall. i.e., as in traditional commercial refrigerators and taking advantage of natural convection.

FIG. 2 shows a sectional view of the inner part of the apparatus of the present invention which shows a section of the external cover of the apparatus, the immersion tank (11) and the coil (15), while the rest of the components are not shown in sectional view, to facilitate interpretation.

The external cover of the apparatus comprises mainly the above mentioned lower casing (28) which is very useful for floor-standing embodiments. The external cover also includes an upper casing (31), intended to cover the various upper components placed above the counter (12). Said counter (12) may also function as a lid for the immersion tank (11), although said immersion tank (11) may conveniently have its own lid identified by numeral (17). Said tank lid (17) includes an upper inlet (20) through which the beverage container (2) may be introduced or submerged.

Such as any person with an ordinary skill in the art may appreciate, when the immersion tank (11) has its own tank lid (17), the various contacting parts may be sealed and/or insulated by means of gaskets, seals or the like, which prevent or reduce leakage of frigories, the transmission of vibrations, misalignment of adjacent parts, etc. In the figures, the counter (12) is tightly attached to the tank lid (17).

However, as can be seen in FIGS. 2 to 4, access to the interior of the tank is from the top, through the corresponding openings described in detail below.

In particular, the apparatus has a rotating disk (18) comprising a rotating opening (8), and, on top of it, a fixed disk (19) including a fixed opening (9). Said fixed plate (19) covers the upper part of said rotating disk (18). In this way, the fixed opening (9) of the fixed plate (19) is generally concentric with the tank inlet (20) such that the rotation of the rotating disk (18) allows for the rotation of the rotating opening (8) thus closing or opening access of the packaged beverage (2) into the immersion tank (11), as desired.

For the purposes of the present invention, closing or opening access of the beverage container (2) into the immersion tank (11) as convenient means that, for example, where a revolving door (22) is available such as illustrated in FIG. 1, the rotating disk (18) turns together with said revolving door (22) such that when the revolving door (preferably, without limitation, a transparent or translucid door provided with a handle (23)) prevents access to the container loading/collection area, the rotating opening (8) generally matches with the rest of the openings (namely, the fixed opening (9) and the inlet port (20)) so that the beverage container may be introduced into the immersion tank (11). And, on the contrary, when the revolving door (22) is opened, either by rotating it with the handle (23) or automatically, the rotating disk (18) that is moved together with the door (22) also rotates and the rotating opening (8) is moved so that the disk body itself of the rotating disk (18) prevents access to the interior of the immersion tank (11). In this way, leaks of frigories from the immersion tank are diminished (11) and a safe apparatus is provided even with liquid refrigerants such as alcohol. In particular, the apparatus will be provided with its door (22) open by default, such that access to the immersion tank will be prevented when not in use.

The above is a clear explanation of the way in which access to the inner part of an immersion tank (11) is achieved, where the tank contains a liquid refrigerant at temperatures as low as −30'C, more preferably −40'C and even more preferably −50° C. as may be appropriate. The following description discloses in detail the rest of the apparatus that produces the technical effect of rapid cooling of a packaged beverage (2).

As shown in FIGS. 1 and 2, the beverage container (2) is tightly held even when it is outside the immersion tank (11) using gripping means (3). Said gripping means (3) have been preferably put into practice in an embodiment wherein a clamp has multiple jaws, and may include, for example, an elastic bracing such as a toroidal ring (29) helping to keep the clamp jaws tight on the beverage container (2).

Although a preferred embodiment of the gripping means (3) has been illustrated, any person of ordinary skill in the art will understand that other specific types of gripping means may be used, such as for example: a holding pressure cup, an adjustable mandrel, a flange or other gripping means, in that way the gripping means may be adapted to the type of container or even to a certain variety of containers that may be expected to be used with the apparatus (1). Furthermore, as said gripping means (3) are mounted on a rotation axis (4), a set of different gripping means (3) may be provided to be attached to said rotation axis (4) to adapt the apparatus to a wide variety of beverage containers (2).

Therefore the apparatus of the present invention provides gripping means (3) for at least one container (2), said gripping means (3) being connected to a vertical rotation axis (4), where said vertical rotation axis (4) is driven by first driving means (6). Although for the purposes of the present invention the first driving means have been identified as a motor, such as an electric motor, any person with an ordinary skill in the art will understand that any driving means capable of causing rotation of the vertical rotation axis (4) may be used. Therefore the container (2) containing the beverage of interest to be cooled to a desired temperature by the consumer may be held by the gripping means (3) which in turn will transmit the axial rotation motion from the first driving means (6). As illustrated in the accompanying Figures, said means may include, at the designer's choice, belts and pulleys connecting the vertical rotation axis (4) with the rotation axis of an electric motor, or else a driving means (6) may be provided acting directly on the vertical rotation axis (4). In other words, as long as the driving means (6) are capable of causing rotation of the rotation axis (4), of the particular design, it may be varied as deemed convenient.

As specified above, said immersion tank (11) is preferably cylindrical, includes an inlet port for containers (20) which can be closed by means of a rotating disk (18) comprising a rotating opening (8), and said gripping means (3) may pass through said inlet port (20) and said rotating opening (8) when said container inlet port (20) and said rotating opening (8) are vertically aligned. As explained above, said inlet port (20) and said rotating opening (8) are aligned when the revolving door (22) rotates to a closing position of the beverage container feeding/collection area of interest to the consumer.

In a preferred embodiment, the gripping means (3) of the beverage container (2), the vertical rotation axis (4) and the first driving means (6) are mounted on the arm of a vertically moving cart (5). In other words, it must me ensured that the vertical rotation axis (4) is supported by the vertically movable cart (5) thus allowing the beverage container (2) to move vertically, upwards and downwards in a vertical axial direction.

The vertically movable cart (5) supporting said vertical rotation axis (4) can be driven by a second driving means (10), comprising, for the purposes of the present embodiment, a second electric motor connected by means of belt and pulleys to a worm gear (16) along which a nut or recirculating ball bearing or the like can screwingly advance, so that the rotation of said worm gear (16) driven by the second driving means (10) causes an upward or downward vertical motion (depending on the sense of rotation of the worm gear (16)) and consequently the up and down movement of the container (2) containing the beverage of interest.

As shown in the Figures, the vertically movable cart (5) supporting said vertical rotation axis (4), is conveniently guided along a pair of vertical displacement guides (7) adequately connected to the structure of the apparatus providing over said vertically movable cart the corresponding lubricated ball bearings, etc. Such as known by any person with an average skill in the art, the particular way in which the driving means (6, 10) finally achieve the axial rotation movement around the vertical axis of the container (2) and the vertical reciprocating movement of the container (2) (up and down) which are necessary to achieve the technical effect of controlled rapid cooling of the present invention may vary as long as said technical effect is achieved as described in detail below.

The description above provides an apparatus (1) with the necessary and sufficient structure to obtain an axial rotating movement of the container (2) (turning of the vertical rotation axis (4)) to achieve a vertical reciprocating movement of the container (2) (up and down displacement of the vertically movable cart (5)) where said driving means (6, 10) are operably connected to a control unit (30) so as to obtain the advantageous technical effect of the present invention that provides rapid cooling to the temperature of consumption desired by the consumer, where the control unit (30) operatively connected to at least said first driving means (6) and said second driving means (10) commands the following sequential steps:

I) driving the rotation of said axial rotation axis (4) at a speed range from 500 RPM to 2500 RPM for a period of time ranging from 0.1 seconds to 7 seconds, II) slowing down of the rotation of said axial rotation axis (4) to a speed not exceeding 500 RPM, and the simultaneous vertical reciprocating movement of said vertically movable cart (5), for a period of time ranging from 0.1 seconds to 3 seconds, III) establishing the number of repetitions of steps I) and II) up to the final stop of the rotation of said axial rotation axis (4).

It is clear that the sequential steps mentioned above are performed once a packaged beverage (2) has been submerged into the immersion tank (11), as illustrated in FIG. 3 and enlarged in FIG. 4.

Said control unit (30), may be implemented in different manners. i.e., by including within the apparatus (1), a computer, electronic boards, plates, memory cards forming said control unit, a standard programmable logic controller, and any other accessories that may be convenient, such as, screens, viewers, touchscreens, keyboards, control lights, temperature sensors, rev counter, as well as a bar code reader (32) or any other type of code reader, for example (QR), etc. This means that it is possible to provide the control unit (30) of a plurality of data input and output peripherals for controlling and sensing different variables of the environment, for example, it is possible to provide a gas sensor to control the emission of flammable volatile gases, a contactless temperature sensor to measure the temperature of the various components of the apparatus, and even of the container being cooled, inter alia.

Summing up, the importance of the control unit (30) is its technical capacity of optimizing the cooling speed of the packaged beverage (2) thus minimizing the consumer's waiting time once he or she has selected the beverage to be consumed right away, starting from a packaged beverage at room temperature (usually at 25° C.), i.e., without previous refrigeration.

The sequential steps mentioned above are considered essential because it has been demonstrated that they are surprisingly efficient in cooling the packaged beverages of interest in the present invention. The control unit (30) may be implemented by means of an electronic control unit, including microprocessors, memory cards, etc. operatively connected, for example, through wiring, to encoders and drivers, or else through wireless connections, to at least said first driving means (6) and said second driving means (10), to command said sequential steps described below with reference to an exemplary refrigeration method for a soda can.

Example of Rapid Cooling of a 355 mL Soda Can

In the first place, the user of the apparatus for rapid cooling (1) selects a particular beverage container (for example a 355 ml (12 oz.) soft drink can) from a traditional (non-refrigerated) tray or supermarket shelf, i.e., at a normal ambient temperature of, for example, 25° C.

Then the user places the container, hereinafter referred to simply as the "can" (2) in the cup serving as gripping means (3), with the door (22) in the open position, said can being held in position as shown in FIGS. 1 and 2, then the user closes the access door (22) (by turning it clockwise as shown in the figures) or the door closes automatically by pressing a pushbutton, etc. so that the can remains isolated within the apparatus. The closing of the revolving door (22) causes the rotating disk (18), fixed to said door (22) to rotate until the rotating opening (8) becomes aligned with the inlet opening (20) of the immersion tank (11) and also with the fixed opening (9) of the fixed plate (19), thus clearing the way of the can into the immersion tank (11), as shown in FIGS. 1 and 2.

Such as an expert in the art will understand, since the apparatus of the present invention if provided with a control unit (30), the user may enter, for example by means of a keyboard or touch screen (not shown), the desired cooling temperature for the beverage he/she is about to drink. Additionally, the control unit (30) may sense multiple variables or collect data such as:

Initial temperature of the container (2), by means of a contactless temperature sensor or infrared thermometer (not shown).

Current temperature of the liquid refrigerant (14) within the immersion tank (11), either by means of temperature sensors (thermometers, thermocouples, etc.) or by entering data through an interface (not shown) operatively connected to the control unit (30).

Quantity of liquid refrigerant (14) within the immersion tank (11) for example, by means of an ultrasound sensor, by measuring the distance between the sensor itself and the free surface of the liquid refrigerant (14). Other ways to measure the contents in the tank are also available, such as measuring by weight, floating devices, measuring the pressure beneath the free surface of the liquid as a function of depth, etc.

Type of container and beverage (2) introduced into the apparatus, identifying for example, its brand name, commercial name, net contents of the container (cu.cm, ml, etc.), the shape of the container, etc. by means of a bar code sensor (32), which is illustrated by way of example only. In case the brand name, commercial name, type of beverage in the container to be cooled, can be recorded or acknowledged, the control unit (30) can interrogate a data base (internal memory, network data base, internet access, internal and/or external, removable or fixed storage base, etc.) and determine the thermal capacity of the container (2) and that of the beverage to be cooled, besides that of the cooling medium itself.

Additionally, such as a person skilled in the art will understand, the apparatus may be provided with a variety of sensors, switches, and sensing means for the position of the vertically movable cart (5), by means of a position encoder, etc. The above can also be applied to the position of the axial rotation axis (4) of the container, by means of position encoder, angular motion, etc.

Once such data has been sensed and/or entered, the control unit (30) will determine the operating parameters. i.e., the rotational speed (RPM) at which the container will rotate along the various stages, the amplitude and speed of the reciprocating motion of the vertically movable cart (5) and the number of cycles that the apparatus will perform until the rotation of the container stops, to be then lifted and removed from the apparatus by the consumer.

Once the necessary data has been sensed, collected or entered, including, for example, the type of container and the beverage to be cooled, the cooling procedure is started, for example, by pressing a start pushbutton (not shown).

Upon the start of the cooling procedure based on the apparatus of the present invention, the control unit (30) will have, for example, the following reference data:

The initial temperature of the container introduced into the apparatus (2) is 25° C.

The current temperature of the liquid refrigerant (14) is −42.5° C.

The immersion tank (11) contains 15 liters of liquid refrigerant (14).

The type of container (2) introduced into the apparatus is an aluminum can (with a known heat capacity, either entered by the user, or selected from a data base available for the apparatus), having a capacity of 355 ml (such capacity either entered by the user or taken from a data base through the previous reading of the container bar code), and the type of liquid beverage within the container is a carbonated cola beverage, which thermal capacity may either be entered through an interface, or taken automatically from a data base by the control unit (30) as mentioned hereinabove.

The position of the vertically movable cart (5) is sensed in its upper end position, i.e., initially the control unit (30) will acknowledge that the vertically movable cart is placed in an appropriate position allowing the safe entrance of a container (2) to be held within the gripping means (3).

The speed of rotation of the axial rotation axis (4) is zero immediately before the container is introduced into the immersion tank (11).

Such as illustrated above, the apparatus for the rapid cooling of packaged beverages, has the ability to determine the number of times that the above-mentioned stages I) and II) will be repeated up to the final stop of the rotation of said axial rotation axis (4) by means of the control unit (30), based on at least the following reference data:

Initial Temperature of the container (2);

Current temperature of the liquid refrigerant (14);

Quantity of liquid refrigerant (14) in the immersion tank (11);

Type of container (2) to be introduced;

Type of liquid beverage contained in the container.

Additionally, said reference data may also advantageously include:

the thermal capacity of the container (2);

the thermal capacity of the liquid refrigerant (14);

the thermal capacity of the liquid beverage contained in the container.

Such as an expert in the art will understand, the thermal capacity of something is the quotient between the amount of thermal energy transferred to it and the resulting change of temperature on it; therefore, knowing the thermal capacity of the above mentioned matter will allow to predict the amount of heat necessary to transfer to/evacuate from it in order to reach the desired temperature in the matter of interest. It should be noted, however, that by knowing the type of container to be cooled, the type of beverage in the container and the liquid refrigerant used in the apparatus, it is also possible to store reference data in data bases where the respective typical and/or specific thermal capacities can be found.

In that regard, and such as an expert in the art will understand, the inclusion of the control unit (30) in the apparatus of the present invention, is essential in order to produce the technical effect consisting in the fast cooling in the distinguishable way hereby proposed. Based on the teachings disclosed herein, someone with average skill in the art will be able to put into practice, i.e., to program the control unit (30) and to provide it with the necessary peripherals and internal components, as well as the appropriate communication means, including the access to networks and/or peripherals, interfaces, etc., so as to provide the expected technical effect consisting in moving the axial rotation axis (4) and the vertically movable cart (5) in an appropriate way as proposed herein.

It should also be noted, although exclusively for the sake of clarity and by way of example of the present invention, that the axial rotation axis (4) is actuated by a driving means hereby referred to as first driving means (6), and that the vertically movable cart (5) supporting said axial rotation axis (4) is actuated by a driving means hereby referred to as second driving means (10), an expert in the art will be clearly able to propose other equivalent mechanisms, probably more complex, and may be less efficient, which combine said first driving means (6) and said second driving means (10) in a single and more complex driving means. It is apparent that the development of technology allows for methods of actuating axes, carriages and the like in most diverse ways, however it has been clearly specified that the control unit (30) provides two different control commands to the moving parts of the apparatus for rapid cooling (1), one to rotate the axial rotation axis (4) and the other to achieve the vertical reciprocating motion of the vertically movable cart (5), and therefore the single driving means, or the various driving means, can be included in the most diverse ways, without it implying any limitation to the exemplary embodiment illustrated herein.

Therefore, the control unit (30) operatively connected to at least said first driving means (6) and said second driving means (10), for the case of having to cool a 355 ml can, will perform as follows:

The control unit (30) will order the vertically movable cart (5) to descend to a position ensuring a complete immersion of the container (2), generally coinciding with the center of the immersion tank (11), more preferably generally centered within the first inner section (15*a*) of the evaporator coil, in other words, making sure that the container (2) is completely submerged in the liquid refrigerant (14) in a lower initial position for its descent. This technical effect consisting in introducing the container is controlled by the control unit when the can (2) is removed from the immersion tank (11) and the access door (22) is closed, then said gripping means (3) may pass through said inlet port for containers (20) and said rotating opening (8), then said inlet port for containers (20) and said rotating opening (8) are vertically aligned, being the access door (22) closed, then the can is lowered until it is submerged into the liquid refrigerant (14). At that point in time, assuming the apparatus is working in its optimal operating conditions, the temperature of said liquid refrigerant (14) is preferably in the range of −28 deg C. to −42.5 deg C., and the preferred liquid refrigerant for the operation of the present invention is an alcohol, such as ethyl alcohol (ethanol). It should be noted that the viscosity of ethyl alcohol increases with lower temperatures, and has a melting point of −114 deg C. therefore the immersion tank is calculated so that it is capable of withstanding the selected operating temperature, and is also provided with suitable thermal insulation conditions.

The control unit (30) will order the container (2) to undergo a specific number of repetitions of steps I) and II) mentioned above (namely, Step I) driving the rotation of the axial rotation axis (4) and Stage II) slowing down of the rotation of said axial rotation axis (4) and the simultaneous vertical reciprocating movement of the vertically movable cart (5)), all of the above until the final stop of the rotation of said axial rotation axis (4) and then, the subsequent lifting of the vertically movable cart up to its upper final position for the withdrawal of the container.

In the particular case of the exemplary can (355 ml metal can with carbonated beverage), the control unit (30) will advantageously command that the container be subjected to a technical effect consisting in rapid cooling, thanks to the application of a rotation stage, causing the container to rotate around its axial rotation axis (4) at a speed of 1100 RPM during 0.5 seconds, then a step in which the rotational speed around said axial rotation axis (4) is lowered to 120 RPM for an additional 0.5 seconds, simultaneously with a vertical run distance of 2 cm (for example with an oscillation frequency of 50 Hz, without this being a limitation), and preferably ensuring at least a reciprocating vertical motion. Said steps are repeated 20 times thanks to the arrangement provided by the apparatus of the present invention, thus resulting in a total cooling time of 20 seconds, which implies a great advantage over the prior art.

It should be noted that, although in the preceding example specific times, motions and speeds have been specified for a 355 ml can, it becomes apparent for an expert in the art that once the can is submerged into the liquid refrigerant (14), the control unit will control I) the drive for the rotation of said axial rotation axis (4), as a reference at a speed range from 500 RPM up to 2500 RPM for a period of time ranging from 0.1 seconds to 7 seconds, this causing the rotation of the beverage inside the can (container), so that a so called static vortex is formed at a particular point in time, i.e. the liquid in the container, is distributed within the container with the shape of a vortex, rotating as if it were a solid body. The formation of such vortex therefore cancels the benefit of making the container to rotate in order to provide a permanent change of the contact surfaces between the container and the beverage. For that reason, such vortex, pursuant to the object of the present invention, is rapidly made to collapse by means of stage II), in which the rotation of said axial rotation axis (4) is slowed down to a speed not exceeding 500 RPM, with the simultaneous vertical reciprocating motion of said vertically movable cart (5), during a period of time ranging from 0.1 second to 3 seconds. In this way, the undesirable complete stop of the rotation of the container is avoided, contrary to what is proposed in the prior art documents. Regarding step II) during which the rotation of said axial rotation axis (4) is slowed down, and just by way of reference, said slowing down is carried out by lowering the previous rotational speed to a preferred speed of, for example, 50 RPM, while simultaneously applying said vertical reciprocating movement of said vertically movable cart (5). The preferred amplitude of the vertical reciprocating motion is 4 cm (although other amplitudes are also acceptable depending on the design), and it has been found advantageous to complete at least one vertical reciprocating cycle (in the direction of the force of gravity) during the slowing down stage, so that the forced collapse of the vortex into the container is effected. Such as an expert in the art will understand, the amplitude of the vertical motion (cm), the speed of the vertical motion and the duration of the slowing down step (sec) can be varied within a certain practical range so to conveniently adjust them to, for example, the type of beverage in the container, etc. To that purpose, the control unit (30) is capable of performing a calculation logic, either predictive or by previous learning based on the data gathered from peripherals and sensors, and/or from data entered by the user through the interface. Despite the above, the inventors of the present cooling apparatus (1) for packaged beverages have found that, regardless of the variation of the above mentioned parameters, the stirring resulting from the reciprocating motion along the axial vertical axis and coinciding with the direction of the force of gravity is essential, since it is believed that said stirring, reciprocating or vertical motion causes a surprising effect on the collapsing of the vortex in the direction of the force of gravity, since this force is the main cause for the geometry of the vortex generated within the container.

In contrast, it should be noted that, according to the known prior art, such as in document US2013/0160987, the complete stop of the beverage container (2) would imply letting the rotational speed of the vortex to slow down naturally. (in other words, as if the machine had been turned off), which would require a large period of time to elapse, without exerting any kind of influence on the behaviour of the vortex; consequently, in the embodiments of the prior art, it takes waiting times from 10 to 60 seconds for the vortex to collapse.

Surprisingly, it has been found that the combination of the slowing down of the rotation (but without stopping it completely) with the simultaneous reciprocating motion of said vertically movable cart (5) in order to move the can axially in the vertical direction (same as the direction of the force of gravity), during a period of time as short as for example 0.1 seconds, i.e., during substantially short periods of time according to the apparatus of the present invention, allows for the immediate collapse of the vortex, making the time necessary for the vortex to collapse almost negligible, but at the same time optimizing the evacuation of heat from the beverage into the liquid refrigerant (14) where the container (2) is submerged.

Without wishing to be bound by any particular theory, the inventors believe that the substantial improvement achieved in the shortening of cooling times results mainly from the rapid collapse of the vortex caused by the axial motion of the container in the direction of the force of gravity, combined with other factors such as the double helix configuration of the coil (15) and the additional stirring effect of the liquid refrigerant (14) due to the vertical motion during the slowing down stage.

Once the vortex within the can has collapsed, step I) starts again, in case the control unit (30) has determined that a new rotation step must be performed on the container, with the corresponding formation of the vortex and the subsequent collapse thereof, as already explained above for the sequence of steps I) and II).

When the control unit (30) determines that steps I) and II) have been repeated a number of times sufficient so as to reach the desired temperature for the consumption of the beverage (for example, a temperature of 5 deg C. for a sprinkling beverage), the rotation of said axial rotation axis (4) finally stops, and then the vertically movable cart (5) is lifted to allow for the withdrawal of the can (2) by opening the access door (22).

Such as an expert in the art will understand, there is a number of non-essential features, such as for example, the temperature of the incoming can, the type of beverage to be cooled, the volume of the container, the type of material of the container, etc. and also intrinsic features, such as operating temperature, ambient temperature, operating speed, process time and the number of process cycles, among other variables, that can be factored in and processed by means of a logic or a calculation algorithm, to determine the number of times that the above mentioned steps I) and II) shall be repeated until the final stop of the rotation of said axial rotation axis (4), once the can or other type of container containing the beverage of interest has been submerged.

The invention claimed is:

1. Control procedure of an apparatus for the rapid cooling of packaged beverages, the control procedure (1) comprising the following sequential steps:

I) driving through the commanding of a control unit (30) connected to a first driving means (6) the rotation of a vertical axial rotation axis (4) connected to a gripping means (3) for at least one container (2), said rotation within a speed range from 500 RPM to 2500 RPM for a period of time ranging from 0.1 seconds to 7 seconds, said container submerged into a thermally insulated (21) immersion tank (11), said immersion tank (11) containing a liquid refrigerant (14), and an evaporation coil (15) of fluid refrigerant from a closed refrigeration circuit, II) slowing down, without stopping it completely, through the commanding of the control unit (30) the rotation of said vertical axial rotation axis (4) to a speed not exceeding 500 RPM, and simultaneously, through the commanding of the control unit (30) connected to a second driving means (10) for driving a vertically movable cart (5) driving a vertical reciprocating movement of said vertically moving cart (5), for a period of time ranging from 0.1 seconds to 3 seconds.

III) establishing through the control unit (30) the number of repetitions of steps I) and II) up to the final stop of the rotation of said vertical axial rotation axis (4).

2. The control procedure of an apparatus for the rapid cooling of packaged beverages according to claim 1, characterized in that in said step I), the rotation of said axial rotation axis (4) is driven at a speed of 1100 RPM during 0.5 seconds.

3. The control procedure of an apparatus for the rapid cooling of packaged beverages according to claim 1, characterized in that in step II), slowing down of the rotation of said axial rotation axis (4) takes place at a speed of 120 RPM with said simultaneous vertical reciprocating movement of said vertically movable cart (5) with at least one reciprocating movement with a vertical run distance of 4 cm, during 0.5 seconds.

4. The control procedure of an apparatus for the rapid cooling of packaged beverages according to claim 1, characterized in that the number of repetitions of steps I) and II) up to the final stop of rotation of said axial rotation axis (4) is established by the control unit (30) based on at least the following information of reference:

initial temperature of the container (2);

current temperature of the liquid refrigerant (14);

amount of liquid refrigerant (14) in the immersion tank (11);

type of container (2) introduced in the tank;

type of liquid beverage contained in the container.

5. The control procedure of an apparatus for the rapid cooling of packaged beverages according to claim 4, characterized in that said information of reference further includes:

heat capacity of the container (2);

heat capacity of the liquid refrigerant (14);

heat capacity of the liquid beverage contained in the container.

* * * * *